US006729904B2

(12) United States Patent
Nankou et al.

(10) Patent No.: US 6,729,904 B2
(45) Date of Patent: May 4, 2004

(54) TERMINAL FITTING AND A CONNECTOR PROVIDED THEREWITH

(75) Inventors: Yuuichi Nankou, Yokkaichi (JP); Hajime Kawase, Yokkaichi (JP); Ryotaro Ishikawa, Yokkaichi (JP); Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/442,728

(22) Filed: May 21, 2003

(65) Prior Publication Data

US 2003/0228798 A1 Dec. 11, 2003

(30) Foreign Application Priority Data

Jun. 6, 2002 (JP) ..... 2002-166360

(51) Int. Cl.[7] ..... H01R 13/40
(52) U.S. Cl. ..... 439/595; 439/744; 439/752
(58) Field of Search ..... 439/595, 752, 439/839, 744, 752.5

(56) References Cited

U.S. PATENT DOCUMENTS 5,235,743 A 8/1993 Endo et al. ..... 439/886
5,520,548 A 5/1996 Hotea et al. ..... 439/595
5,591,051 A * 1/1997 Ittah ..... 439/752
5,788,536 A * 8/1998 Matsuura et al. ..... 439/595
6,033,262 A * 3/2000 Heimueller et al. ..... 439/595
6,068,524 A * 5/2000 Koumatsu ..... 439/752.5
6,520,801 B2 * 2/2003 Tabata et al. ..... 439/595
6,524,143 B2 * 2/2003 Chen ..... 439/852
6,527,601 B2 * 3/2003 Chen ..... 439/852

FOREIGN PATENT DOCUMENTS

EP 0 827 236 3/1998

* cited by examiner

*Primary Examiner*—Renee Luebke
*Assistant Examiner*—Briggitte R. Hammond
(74) *Attorney, Agent, or Firm*—Anthony J. Casella; Gerald E. Hespos

(57) ABSTRACT

A female terminal fitting (30) is provided for insertion into a female housing (10) from behind. A rear end of an outer wall (37) of the female terminal fitting (30) extending along widthwise direction is embossed to project out, thereby forming a locking projection (52) with a vertex (A) at its front end. The female terminal fitting (30) is inserted into the female housing (10) and a lock (13) in the female housing (10) engages the locking projection (52). The locking projection (52) is more outward than an imaginary triangular pyramid (X) formed by connecting the vertex (A) at the front end, a pair of base end points (B) at the rear edge, and an outward-projecting end point (C).

10 Claims, 17 Drawing Sheets

TERMINAL FITTING AND A CONNECTOR PROVIDED THEREWITH

BACKGROUND OF THE INVENTION

1. Field of the Invention

The present invention relates to a terminal fitting and a connector.

2. Description of the Related Art

U.S. Pat. No. 5,235,743 discloses a connector with a housing formed with cavities. Terminal fittings can be inserted into the cavities and locked in place by resilient deflectable locks that project from an inner surface of each cavity.

A demand exists to make connectors smaller, and accordingly cavities, locks and terminal fittings also must be made smaller. These size reductions create a concern that a force to lock the terminal fittings will be insufficient.

The present invention was developed in view of the above problem and an object thereof is to provide a terminal fitting and a connector which can be made smaller.

SUMMARY OF THE INVENTION

The invention is directed to a terminal fitting that is insertable into a connector housing. The terminal fitting comprises a locking projection with opposite front and rear ends. The front end of the locking projection preferably tapers to a vertex. The rear end of the locking projection, however, extends along the widthwise direction of the terminal fitting and is engageable with a fastening portion in the connector housing. The locking projection is more outward than an imaginary triangular pyramid formed by connecting the vertex at the front end, a pair of base end points located at the rear end, and an outward-projecting end point.

A force may act on the terminal fitting to pull the terminal fitting back from this locked state. Such a force may cause the locking projection to bite in the fastening portion, and could cause part of the fastening portion to enter the inside of the locking projection. The inner volume of the locking projection of the subject invention is larger than the inner volume of the imaginary triangular pyramid formed by connecting the vertex at the front end, the pair of base end points at the rear end and the outward-projecting end point. As a result, a large amount of the material of the fastening portion is permitted to enter the inside of the locking projection at the time of biting. Thus, a force necessary to pull the terminal fitting backward while causing the fastening portion to bite in the locking projection is increased, and a sufficient locking force can be secured even if the terminal fitting is made smaller.

The locking projection preferably comprises a substantially pyramidal portion formed by embossing The rear end of the locking projection preferably has an outward projecting end that is substantially flat along the widthwise direction. Additionally, the locking projection preferably is substantially trapezoidal or rectangular. Accordingly, an engaged area of the locking projection with the fastening portion is larger as compared to a locking portion having a pointed outward-projecting rear end. Thus, the locking force can be made larger.

A rear portion of the locking projection is substantially tubular, and preferably a substantially trapezoidal or rectangular tube. Accordingly, the inner volume of the locking projection can be made larger as compared to a locking projection merely formed into a pyramidal shape. Thus, the locking force can be made even larger.

The rear end of the locking projection is inclined in and up to the back. Similarly, the rear end of the outer wall is inclined in and up to the back continuously with the rear end of the locking projection. The fastening portion preferably is engageable with the rear end of the locking projection and/or the rear end of the outer wall. The locking force can be made even larger since the fastening portion is engaged while overhanging the rear end of the locking projection and the rear end of the outer wall,.

The vertex of the locking projection preferably is slightly rounded. Accordingly, the locking projection can be inserted more easily and smoothly into the housing.

Most preferably, the outer wall comprises a cut away portion, preferably extending over the substantially entire width of the outer wall. A front cut end surface of the cut-away portion is engageable with the fastening portion.

The invention also relates to a connector that comprises a connector housing and at least one terminal fitting as described above. The terminal fitting is to be inserted into at least one corresponding cavity of the connector housing, preferably from behind. The cavity preferably has a projection inserting groove for receiving the locking projection.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector according to the invention includes a female housing identified by the numeral 10 in FIGS. 1 through 17. Female terminal fittings 30 are insertable into the female housing 10 and are electrically connectable with male terminal fittings accommodated in a mating male housing to be connected with the female housing 10. Neither male terminal fittings nor the male housing are shown. In the following description, directions of inserting and withdrawing the female terminal fittings 30 into and from the female housing 10 are referred to as a forward direction and a backward direction, respectively, and reference is made to FIG. 8 concerning vertical direction.

Figure 1:
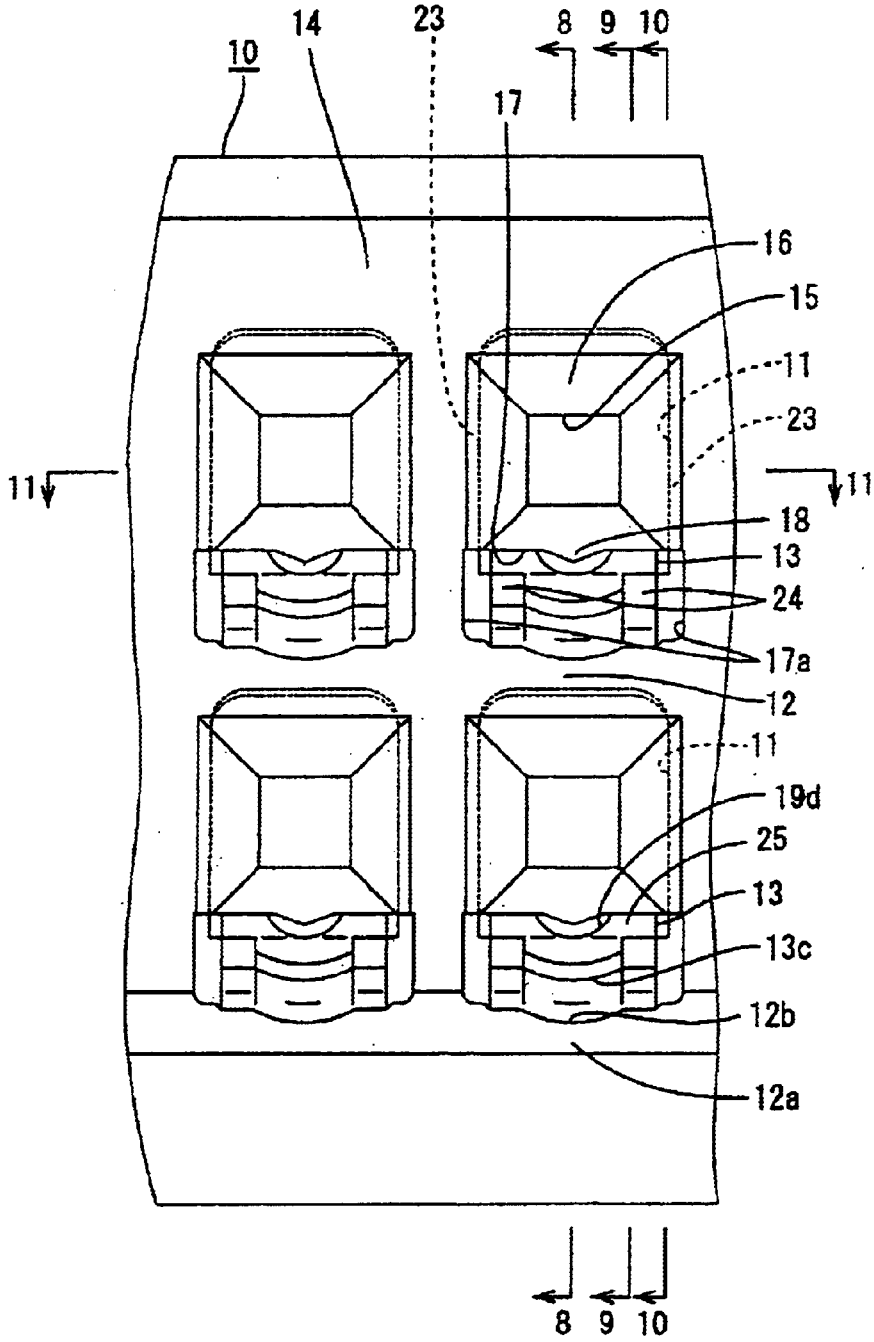
FIG. 1 is a front view of a female housing according to one embodiment of the invention.
Figure 8:
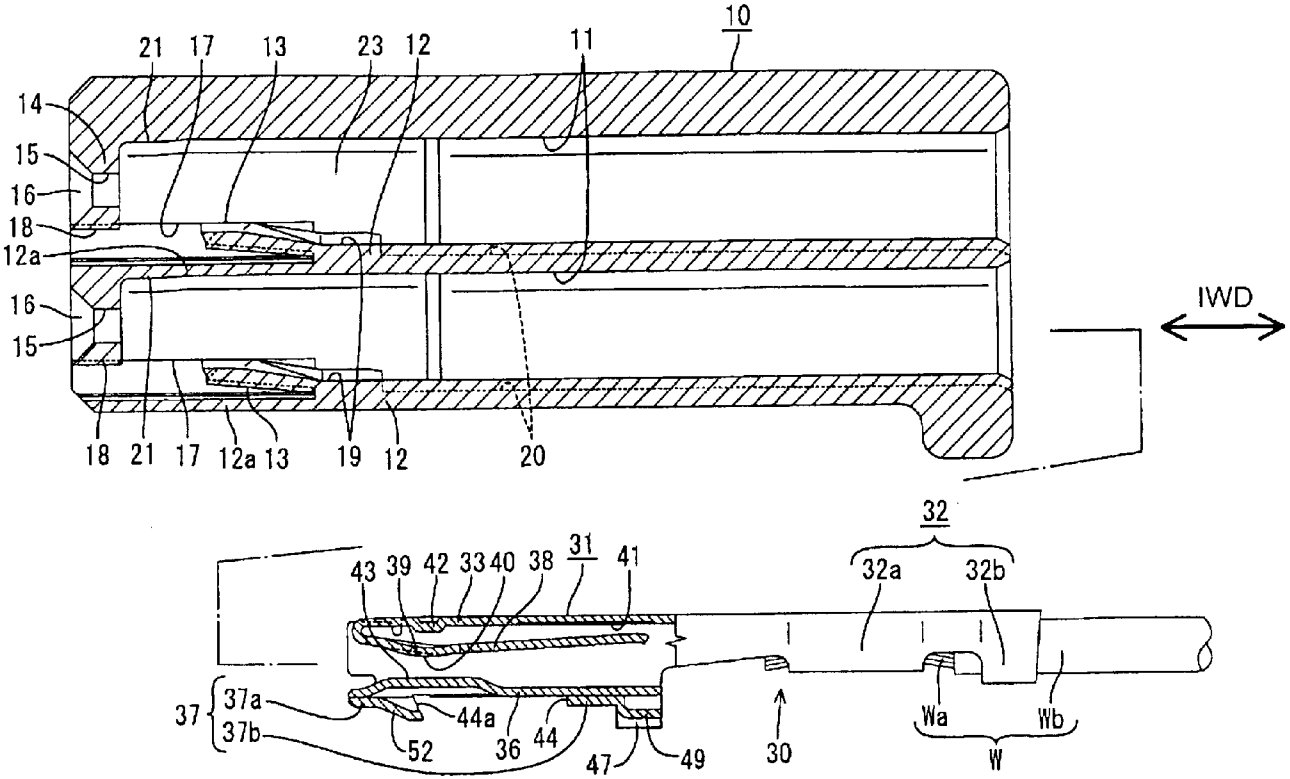
FIG. 8 is a side view in section (the female housing is shown by a section along 8—8 of FIG. 1 and the female terminal fitting is shown by a section along 8—8 of FIG. 4) showing a state before the female terminal fitting is inserted into the female housing.

The female housing 10 is molded e.g. of a resin by front and rear molds which are closed and opened substantially along forward and backward directions, which are parallel to the inserting and withdrawing directions IWD of the female terminal fittings 30. Cavities 11 are arranged substantially side by side along widthwise direction at two stages in the female housing 10, as shown in FIGS. 1 and 8, and the female terminal fittings 30 are insertable from behind into the cavities. The female terminal fitting 30 inserted into the cavity 11 can be locked by a lock 13 that cantilevers from a bottom wall 12 of the cavity 11 and can be supported at its front-limit position by a front wall 14 of the female housing 10. The front wall 14 of the female housing 10 is formed with tab insertion holes 15 for permitting tabs of the mating male terminal fittings to be inserted into the cavities 11 from the front. Converging guide surfaces 16 are formed at the front edges of the tab insertion holes 15 substantially over the entire periphery so that the tabs can be inserted smoothly. Mold removal holes 17 are formed at positions on the front wall 14 of the female housing 10 below the tab insertion holes 15 and displaced in a deforming direction DD of the locks 13. The mold-removal holes 17 are used to remove the front mold for forming the locks 13 during molding the female housing 10. A substantially triangular projection 18 projects down at a widthwise center of the upper end of each mold-removal hole 17 in the front wall 14, and the guide surface 16 is formed continuously at the projection 18.

About ¼ of a front portion of the bottom wall 12 of each cavity 11 is formed to be lower down to form a stepped lowered portion 12*a*, and the cantilevered lock 13 projects forward from the resulting lowered portion 12*a*. The lock 13 is inclined up to the front and gradually projects up into the cavity 11 toward the front end of the lock 13. The lock 13 is resiliently deformable down in a deformation direction DD that intersects the inserting and withdrawing directions IWD of the female terminal fitting 30. More particularly, the lock 13 is deformable about a base end (rear end) as a supporting point when a portion of the lock 13 that projects into the cavity 11 is pressed by the female terminal fitting 30 being inserted into the cavity 11. During this resilient deformation, the lock 13 is retracted into a deformation permitting space defined in the lowered portion 12*a* of the bottom wall 12. The lowered portion 12*a* of the bottom wall 12 that faces the lock 13 from below prevents an excessive deformation of the lock 13 by engaging the lower surface of the lock 13 before the lock 13 undergoes a resilient deformation beyond its resiliency limit. The lock 13 is covered by the lowered portion 12*a* of the bottom wall 12 connected with the front wall 14 over substantially the entire width without being exposed to the cavity 11 located below or to the outside below the female housing 10.

Figure 2:
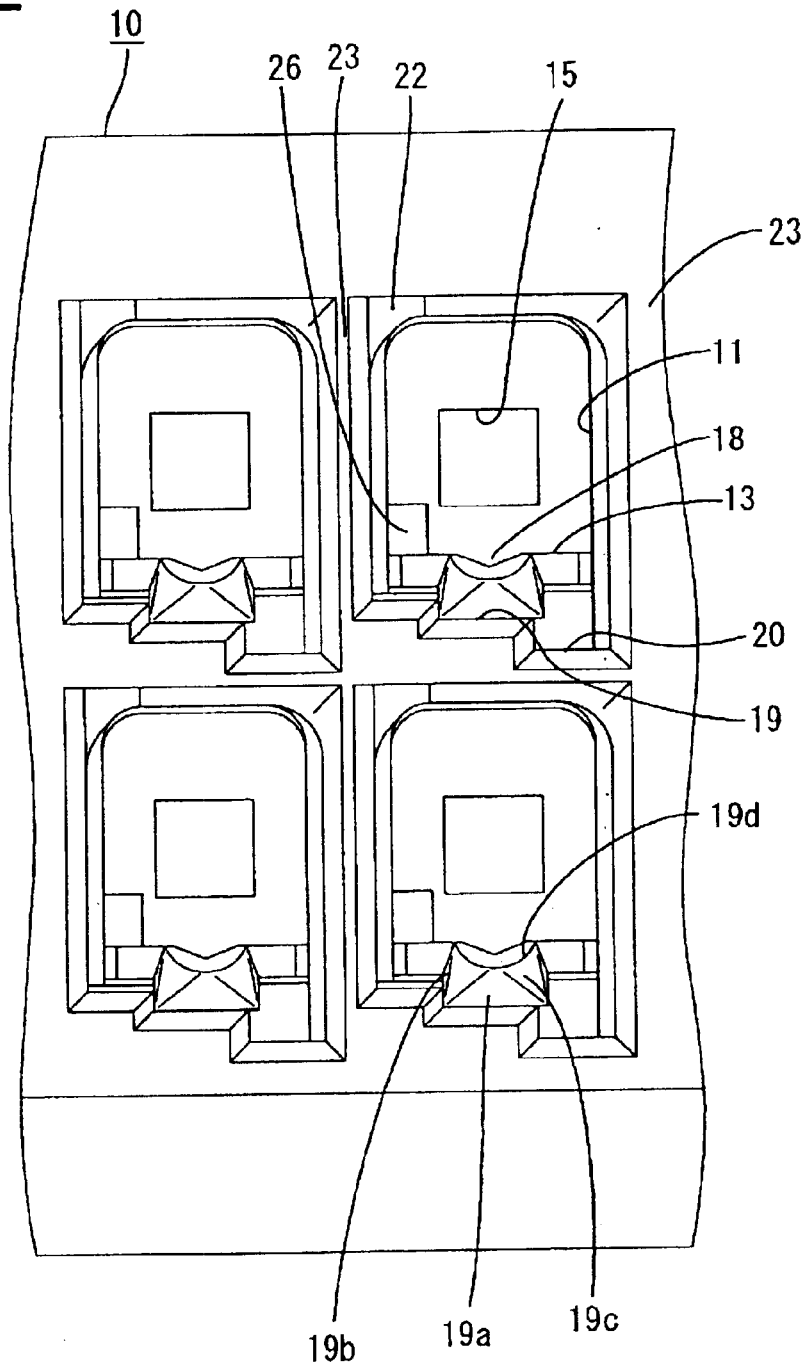
FIG. 2 is a rear view of the female housing.

Grooves are formed at a portion of the bottom wall 12 of the cavity 11 behind the lock 13 and conform with the shape of the female terminal fitting 30 as shown in FIGS. 2 and 8. Specifically, a projection-inserting groove 19 is formed substantially in the widthwise center of the bottom wall 12, and a stabilizer-inserting groove 20, which is deeper than the projection-inserting groove 19, is formed at the right side of the projection-inserting groove 19 in FIG. 2. The projection-inserting groove 19 is formed to be substantially continuous with the lock 13, whereas the front end position of the stabilizer-inserting groove 20 is slightly behind the lock 13. The bottom wall 12, the projection-inserting groove 19 and the stabilizer-insertion groove 20 define a stair-like shape in the widthwise direction (see FIG. 2).

Figure 11:
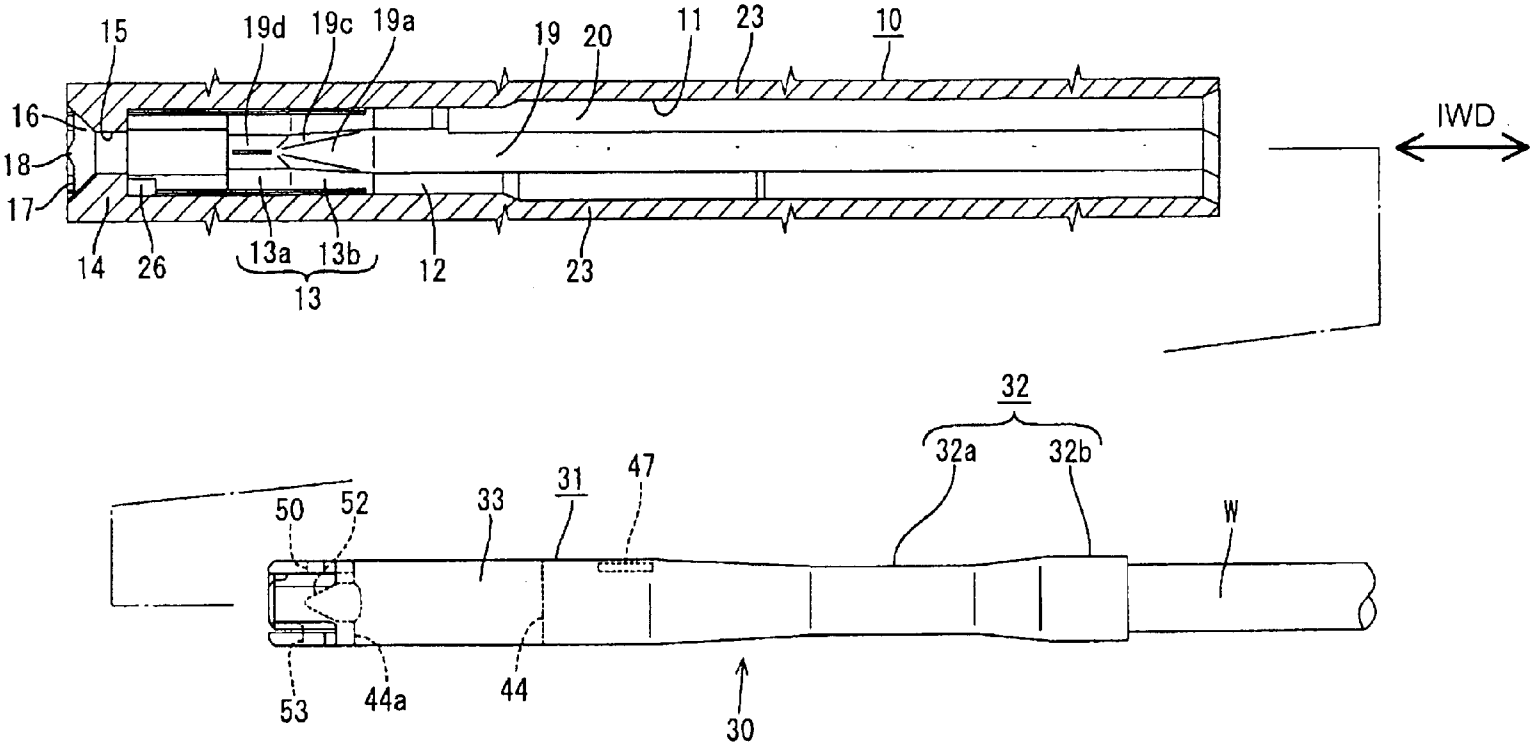
FIG. 11 is a side view in section (the female housing is shown by a section along 11—11 of FIG. 1 and the female terminal fitting is shown by a plan view) showing the state before the female terminal fitting is inserted into the female housing.

A jutting portion 21 is provided at the front end of the upper surface of the cavity 11 and gradually projects in toward the lock 13 over the entire width. The front end of the female terminal fitting 30 inserted into the cavity 11 is pushed toward the lock 13 by the jutting portion 21 to increase a depth of engagement with the lock 13. The peripheral edge of the rear end of the cavity 11 inclines in to the front over substantially the entire periphery to guide the female terminal fitting 30. However, a restriction 22 is provided at an upper-left position of the peripheral edge of the rear end of the cavity 11 in FIG. 2 and extends substantially normal to the inserting and withdrawing directions IWD of the female terminal fitting 30. Further, opposite side walls 23 of the cavity 11 bulge inwardly so that a substantially front half is narrower than a substantially rear half as shown in FIG. 11.

Figure 3:
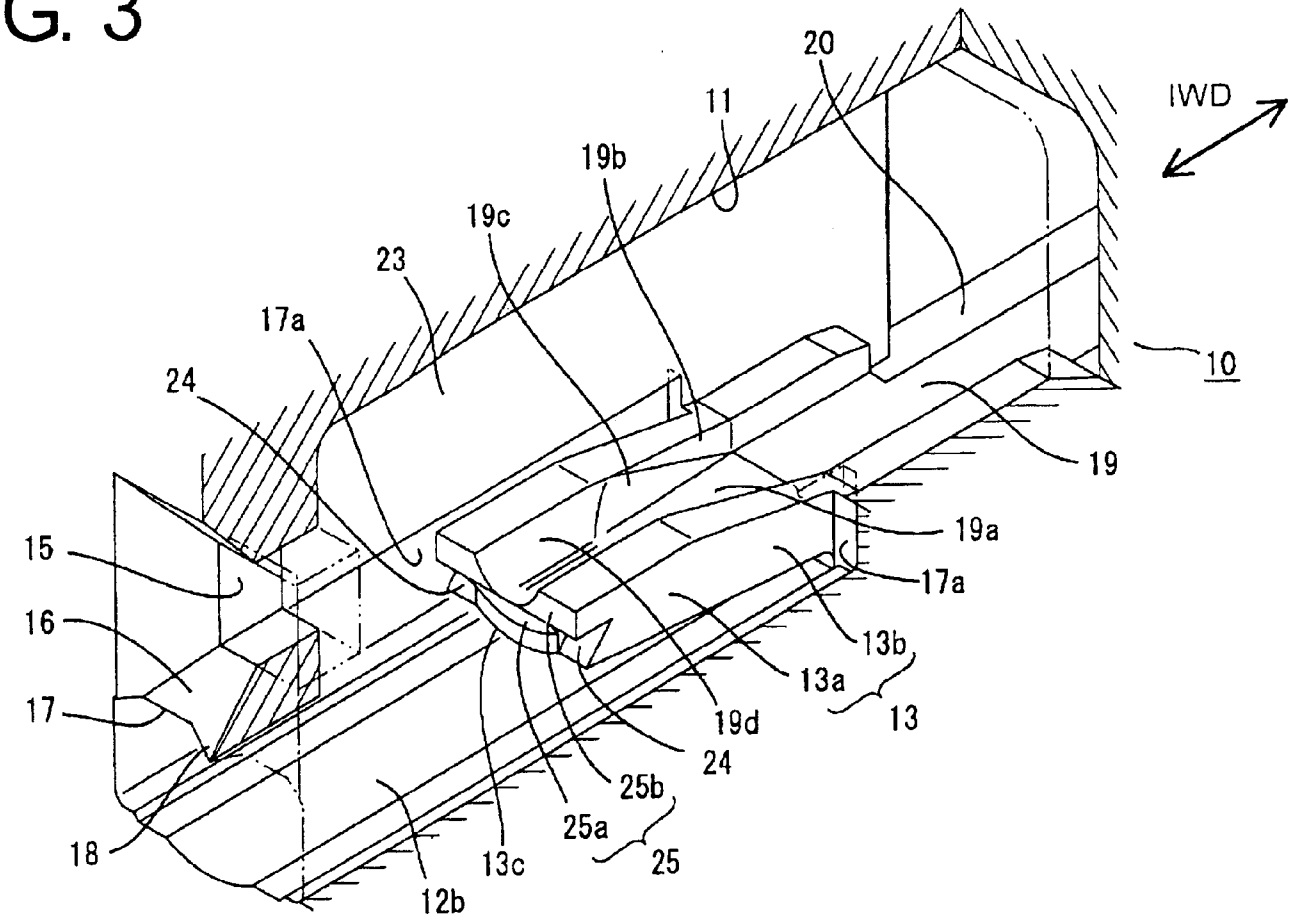
FIG. 3 is a perspective view partly in section of the female housing.

The lock 13, as shown in FIG. 3, has a slanted lower surface that is inclined moderately up to the front over substantially the entire length. The upper surface of the lock 13 is slanted slightly steeper than the lower surface at a rear part 13*b* of the lock 13, but is substantially parallel to the inserting and withdrawing directions IWD of the terminal fitting 30 at a front part 13*a* of the lock 13. The upper surface of the lock 13 is recessed substantially at the widthwise center over the entire length by the projection-inserting groove 19 continuously formed from the rear side of the bottom wall 12. The projection-inserting groove 19 is narrowed gradually from the rear part 13*b* of the lock 13 to the front and is defined by a bottom surface 19*a*, a pair of side surfaces 19*b* extending straight in a vertical direction and a pair of slanted surfaces 19*c* that couple the opposite side surfaces 19*b* and the bottom surface 19*a* and incline inwardly. The projection-introducing groove 19 has an arcuate surface 19*d* of constant width at the front part 13*a* of the lock 13. An arcuate surface 13*c* is formed at the widthwise center of the lower surface of the lock 13 and is curved more moderately than the arcuate surface 19*d* of the projection-introducing groove 19. The arcuate surface 13*c* extends along the entire length. A similar arcuate surface 12*b* is formed at the lowered portion 12*a* of the bottom wall 12.

The lock 13 is slightly narrower the cavity 11 and has constant width over the entire length of the lock 13. The mold-removal hole 17 for the lock 13 is wider than the cavity 11 in the front wall 14 of the female housing 10. Accordingly, notches 17*a* of a specified width are formed in the opposite side walls 23 of the cavity 11 substantially facing the opposite sides of the lock 13. The thickness of the mold for molding the lock 13 can be made larger as much as the widths of the the notches 17*a* and, thus, a necessary strength can be secured for the mold. Conversely, the width of the lock 13 is increased to enhance the strength thereof.

A pair of maneuverable recesses 24 are exposed forward at about ⅗ of the total height of the opposite sides of the front end of the lock 13 and enable the lock 13 to be deformed by a jig (not shown). Additionally, the maneuverable recesses 24 are arranged to be exposed forwardly to the outside even if the lock 13 is engaged with the female terminal fitting 30 (see FIG. 17), and can be pressed down in the deformation direction DD by the jig inserted through the mold-removal hole 17 from the front. Each maneuverable recess 24 is substantially triangular when the lock 13 is viewed sideways. Thus, the upper surface of each maneuverable recess 24 is substantially horizontal, whereas the lower surface thereof is inclined up and to the back (see FIG. 3).

A projection 25 projects forward from the upper part of the front end of the lock 13 and has a height of about ⅔ of the total height of the front end of the lock 13. The projection 25 has a lower part 25*a* with projecting length that gradually increases toward the upper end and an upper part 25*b* above the maneuverable recesses 24 that has a constant projecting length. Thus, the front end surface of the lower part 25*a* of the projection 25 is a slanted up and to the front, whereas that of the upper part 25*b* is substantially vertical. The upper part 25*b* extends across the entire width of the lock 13.

Figure 10:
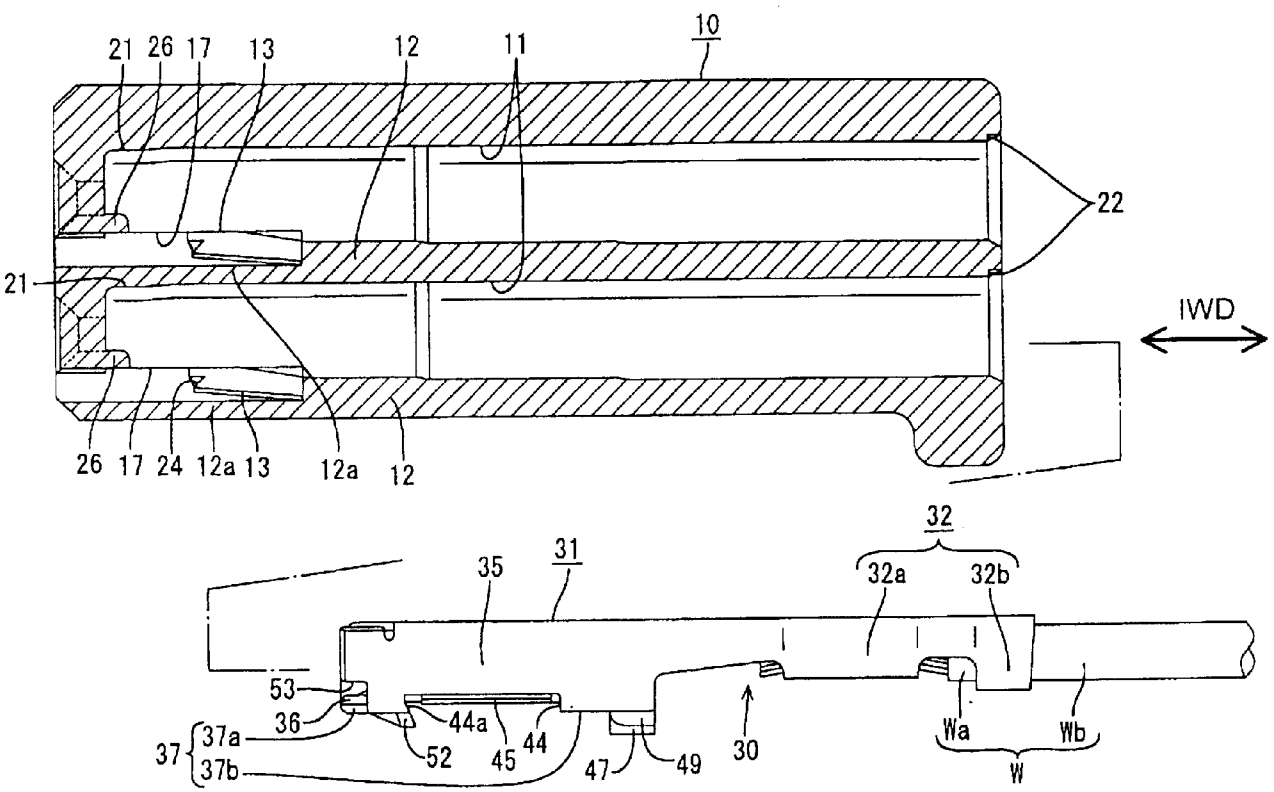
FIG. 10 is a side view in section (the female housing is shown by a section along 10—10 of FIG. 1 and the female terminal fitting is shown by a right side view) showing the state before the female terminal fitting is inserted into the female housing.

A substantially block-shaped support 26 projects in from a corner at the front end of the cavity 11, as shown in FIGS. 2 and 10, and prevents the female terminal fitting 30 from being inclined vertically. The support 26 is coupled to the front wall 14 of the female housing 10 and the left side wall 23 of the cavity 11 to enhance the strength of the support 26. The lower surface of the support 26 faces the mold-removal hole 17.

Figure 5:
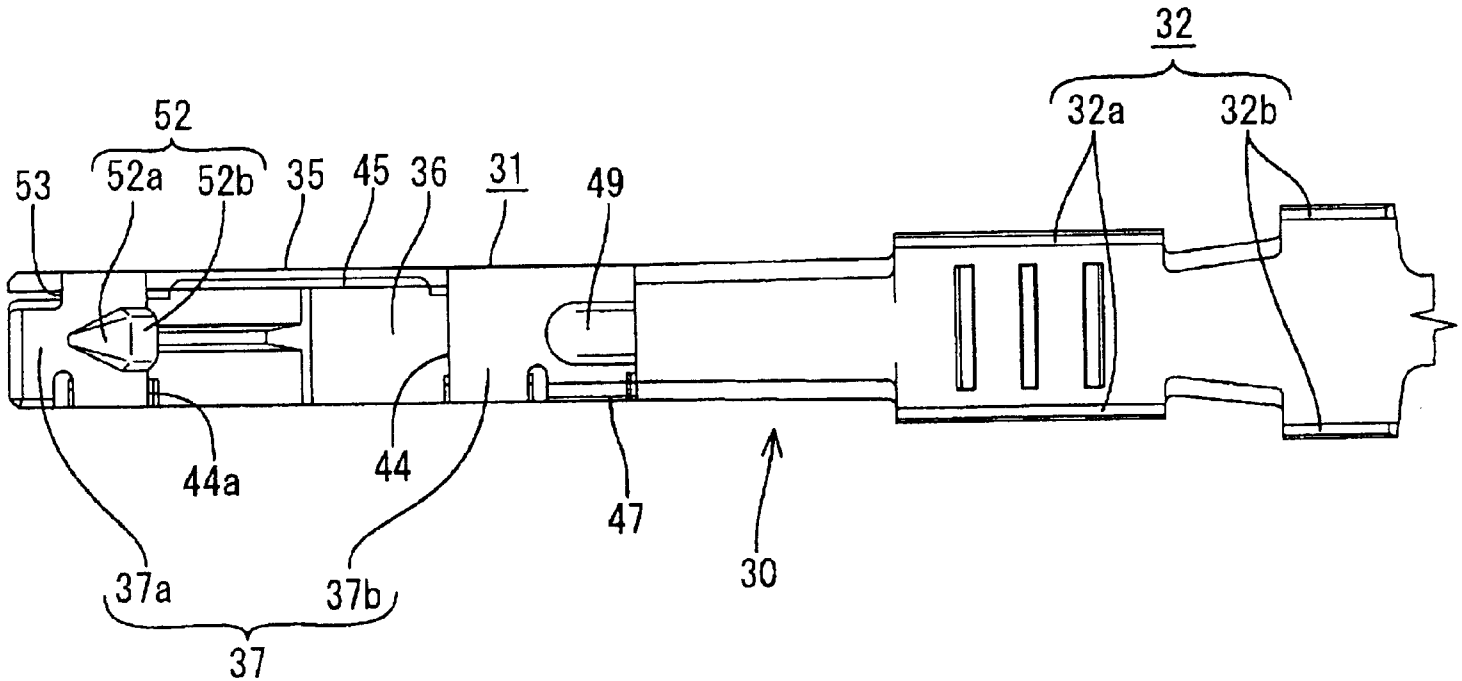
FIG. 5 is a bottom view of the female terminal fitting.

The female terminal fitting 30 is formed into a desired shape by, for example, embossing, folding and/or bending a metallic material stamped or cut out into a specified shape. This female terminal fitting 30, as shown in FIGS. 5 and 8, has a main body 31 substantially in the form of a box with open front and rear ends. A barrel 32 is connected to the rear end of the main body 31 and is configured to be crimped, bent or folded into connection with an end of a wire W. The barrel 32 has a front pair of crimping pieces 32*a* for connection with a core Wa of the wire W, and a rear pair of crimping pieces 32*b* for connection with an insulated portion Wb of the wire W.

Figure 4:
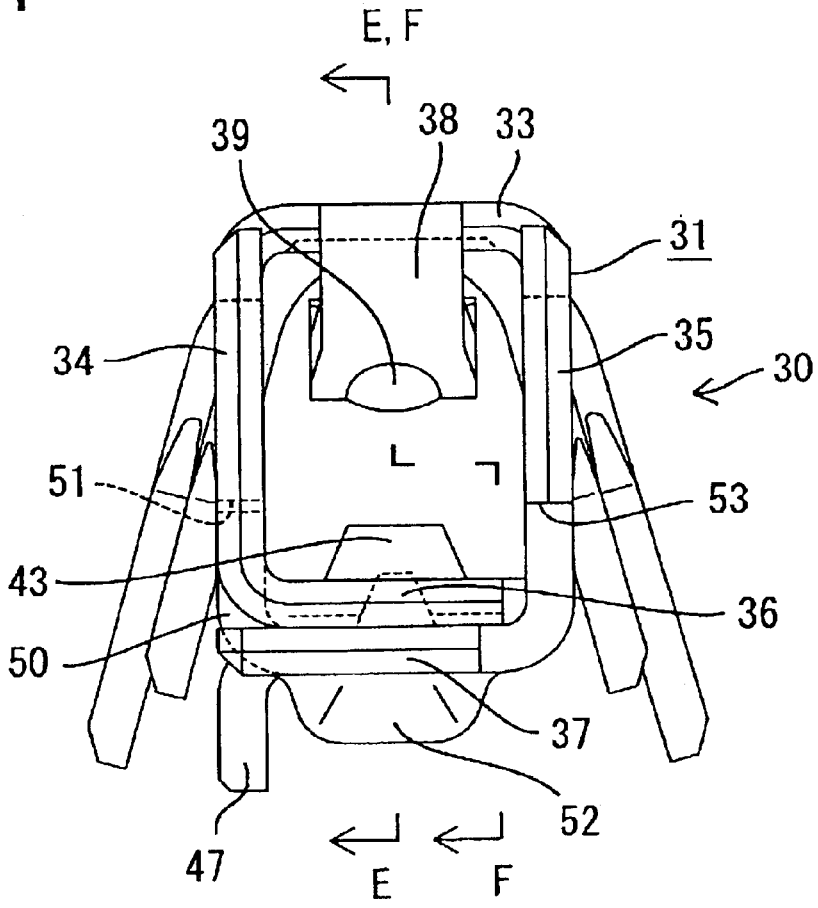
FIG. 4 is a front view of a female terminal fitting.

The main body 31 is comprised of a ceiling wall 33 that extends in forward and backward directions, side walls 34, 35 that extend down from the opposite lateral edges of the ceiling wall 33, a bottom wall 36 that projects from the projecting end of the left side wall 34 of FIG. 4 to face the ceiling wall 33, and an outer wall 37 that projects from the projecting end of the right side wall 34 of FIG. 4 to lie outside of the bottom wall 36.

The front end of the ceiling wall 33 is retracted back as compared to the front ends of the other walls 34, 35, 36 and 37, and a resilient contact piece 38 projects from a U-shaped fold at the front end of the ceiling wall 33, as shown in FIG. 8. The resilient contact piece 38 faces the ceiling wall 33 and the bottom wall 36, and is supported only at the front end of the ceiling wall 33. Additionally, the resilient contact piece 38 has a forward-inclined portion rearward of the U-shaped fold and a backward-inclined portion rearward of the forward-inclined portion. A bulge 39 is embossed in the resilient contact piece 38 to project toward the bottom wall 36 and to extend from the forward-inclined portion to the backward-inclined portion. The bulge 39 is substantially an ellipse that is narrow in forward and backward directions. A contact 40 is defined at the peak of the bulge 39 and can contact with the tab of the mating male terminal fitting. The resilient contact piece 38 deforms resiliently as the contact 40 is pressed by the tab of the male terminal fitting. Thus, the resilient contact piece 38 approaches the ceiling wall 33 with the fold as a supporting point of the resilient deformation. During the resilient deformation, the end of the resilient contact piece 38 can contact the inner surface of the ceiling wall 33. A recess 41 is formed in the ceiling wall 33 for enlarging a degree of resilient deformation of the resilient contact piece 38 and for preventing the deformed resilient contact piece 38 from widthwise displacement.

An excessive deformation preventing projection 42 is embossed in the ceiling wall 33 and projects toward the contact 40. Excessive deformation of the resilient contact piece 38 beyond its resiliency limit is prevented by the engagement of the resilient contact piece 38 with the excessive deformation preventing projection 42. Further, a receiving portion 43 bulges toward the resilient contact piece 38 from a position on the bottom wall 36 facing the bulge 39. The tab of the male terminal fitting can be held and squeezed between the receiving portion 43 and the resilient contact piece 38.

The outer wall 37 is divided into a front portion 37*a* and a rear portion 37*b* by a cut-away 44 formed over substantially the entire width at a substantially longitudinal middle portion, as shown in FIGS. 5 and 8. The lock 13 can enter the cut-away portion 44 over the entire length of the cut-away portion 44 when the female terminal fitting 30 is inserted into the cavity 11, and hence the lock 13 can engage a front cut end surface 44*a* of the cut-away portion 44. The front cut end surface 44*a* of the cut-away portion 44 serves as a locking surface for engaging the lock 13 and is inclined in and up to the back over its entire area. The cut-away portion 44 has a length slightly less than half the length of the outer wall 37 and extends up to the bottom end of the side wall 35 at the upper side in FIG. 5. A bulging piece 45 projects from the projecting end of the bottom wall 36 and contacts the bottom end surface of the side wall 35 to hold the bottom wall 36 substantially horizontal. All of the bottom wall 36 except a contact portion of the bulging piece 45 with the side wall 35 is slightly lower than this contact portion, thereby increasing a depth of engagement with the lock 13. The front portion 37*a* of the outer wall 37 is slightly shorter than the rear portion 37*b* in forward and backward directions.

Figure 6:
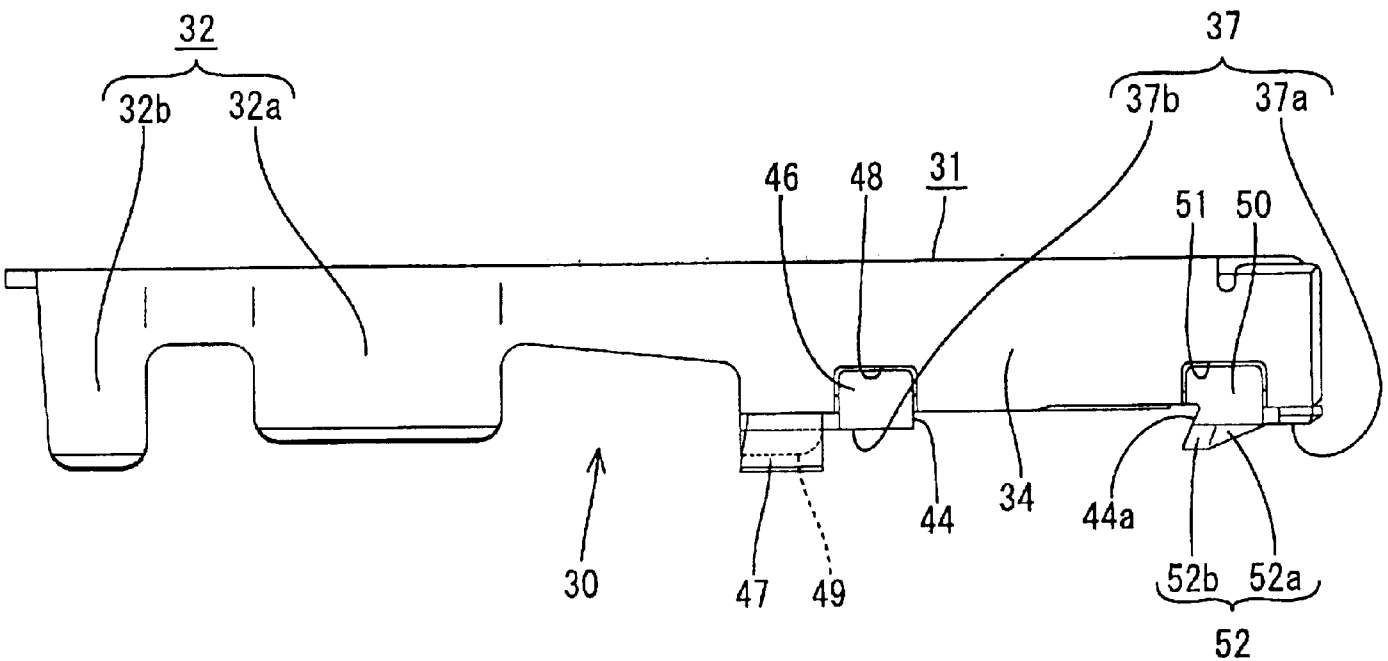
FIG. 6 is a left side view of the female terminal fitting.

A rear-portion holding piece 46 and a stabilizer 47 are provided one after the other at the projecting end of the rear portion 37*b* of the outer wall 37, as shown in FIGS. 5 and 6. The rear-portion holding piece 46 is bent in toward the ceiling wall 33 and the stabilizer 47 is bent out. The rear-portion holding piece 46 fits in a rear-portion holding groove 48 in the side wall 34, as shown in FIG. 6, and hence prevents the rear portion 37*b* from making loose forward and backward movements along the longitudinal direction of the terminal fitting 30. The stabilizer 47 can slide along the stabilizer-inserting groove 20 in the cavity 11 to guide the insertion of the female terminal fitting 30. The front end of the rear-portion holding piece 46 and the front end of the rear portion 37*b* substantially align with each other, whereas the rear end of the stabilizer 47 and the rear end of the rear portion 37*b* substantially align with each other. A projection 49 is embossed to project out from a widthwise center portion of the rear end of the rear portion 37*b* and has a length substantially equal to the length of the stabilizer 47. The projection 49 contacts the bottom surface of the cavity 11 (upper surface of the projection-inserting groove 19) when the female terminal fitting 30 is inserted into the cavity 11.

A front-portion holding piece 50 is provided at the projecting end of the front portion 37*a* of the outer wall 37 and is bent toward the ceiling wall 33. The front-portion holding piece 50 fits into a front-portion holding groove 51 in the side wall 34, as shown in FIG. 6, and hence prevents the front portion 37*a* from making loose forward and backward movements. This front-portion holding piece 50 projects more backward than the front portion 37*a* of the outer wall 37. The cutaway portion 44 extends into the base end of the front-portion holding piece 50, and the cut end surface 44*a* thereof inclines in and up to the back. A side end of the lock 13 is engageable with the cut end surface 44*a*.

Figure 7:
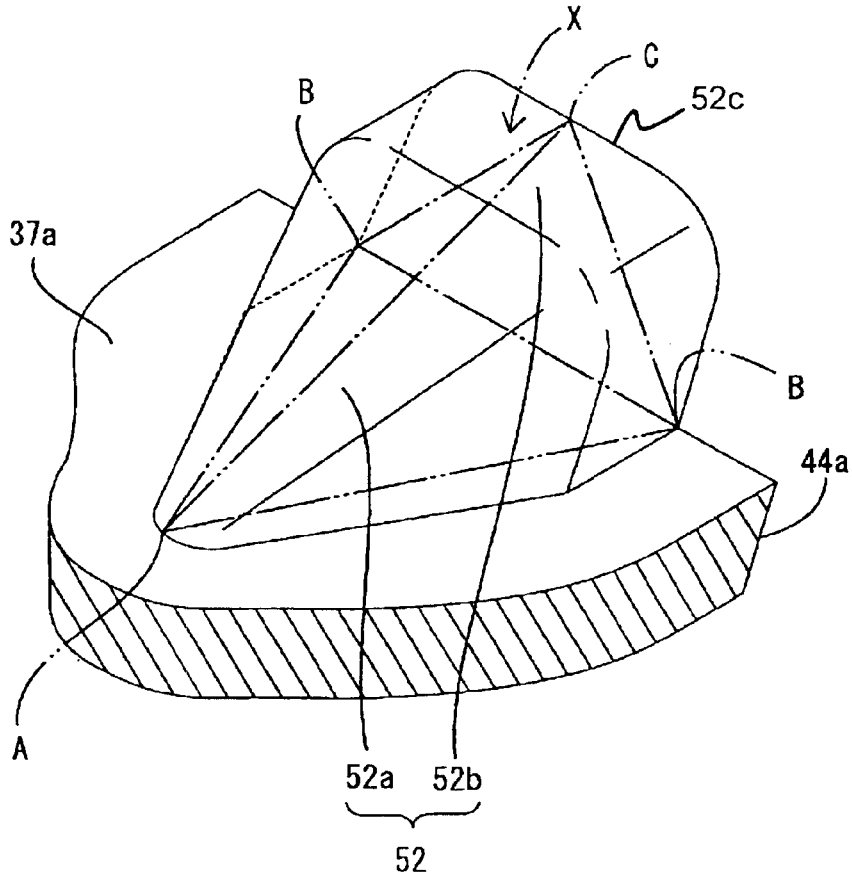
FIG. 7 is an enlarged perspective view showing a locking projection and an imaginary triangular pyramid.

A locking projection 52 is embossed to project out at a position slightly displaced to the left side of FIG. 4 from the center of the rear end of the front portion 37*a* of the outer wall 37, and hence at the front cut end of the cut-away portion 44. The locking projection 52 is engageable with the lock 13. The locking projection 52, as shown in FIGS. 5 to 7, has a pyramid portion 52*a* formed by three slanted surfaces and a substantially rectangular tube portion 52*b* with a substantially constant width and height formed by three side surfaces connected one after the other. The pyramid portion 52*a* of the locking projection 52 is tapered so that the width and height of the locking projection 52 gradually decrease toward the front. The front end of the pyramid portion 52*a* defines a slightly rounded vertex so that the locking projection 52 can be inserted smoothly along the projection-inserting groove 19 in the process of inserting the female terminal fitting 30 into the cavity 11. The substantially rectangular tube portion 52*b* of the locking projection 52 overhangs backward substantially along the inclination of the front cut end surface 44*a* of the cut-away portion 44 and projects more back towards the cut-away portion 44 than the front portion 37*a* of the outer wall 37. Thus, the locking projection 52 is substantially parallel to the front cut end surface 44*a*, which is tapered to incline inwardly at an angle $\alpha$ with respect to the insertion and withdrawal directions IWD, see FIG. 6.

Figure 9:
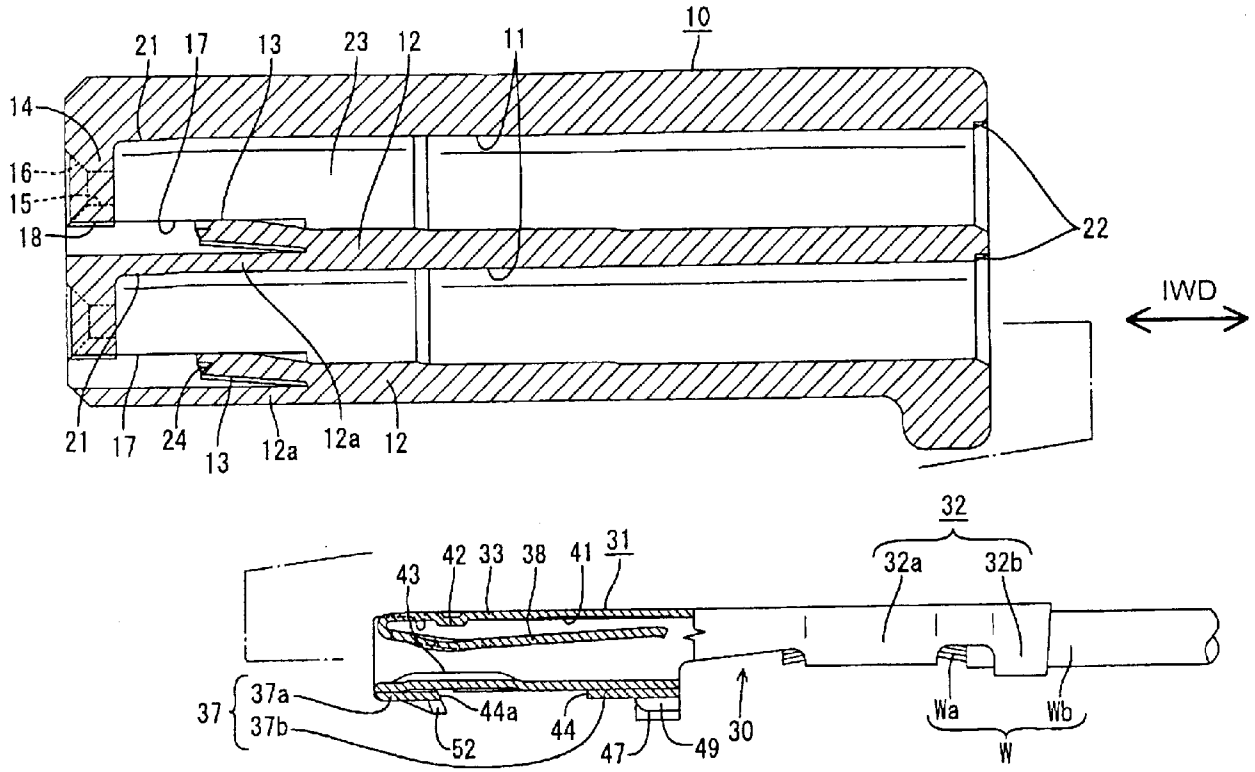
FIG. 9 is a side view in section (the female housing is shown by a section along 9—9 of FIG. 1 and the female terminal fitting is shown by a section along 9—9 of FIG. 4) showing the state before the female terminal fitting is inserted into the female housing.

This locking projection 52 projects up to substantially the same height as the projection 49, and, like the projection 49, is insertable into the projection-inserting groove 19 of the cavity 11. The outward-projecting end of the rectangular tube portion 52*b* of the locking projection 52 is set to reach a part of the lock 13 located below the projection 25, thus ensuring a sufficient depth of engagement with the lock 13. The rear end 52*c* of the locking projection 52 defines a locking surface that engages the lock 13. The rear end 52*c* is formed by the front cut end surface 44*a* of the cut-away portion 44 and inclines in and up to the back. The rear end surfaces of the portions of the front portion 37*a* of the outer wall 37 at the opposite sides of the locking projection 52 also are formed by the front cut end surface 44*a* of the cut-away portion 44 inclined in and up to the back and are engageable with the lock 13, as shown in FIG. 9.

The locking projection 52 projects more outward than an imaginary triangular pyramid X, as shown in FIG. 7. The imaginary triangular pyramid X has a vertex A at the front end of the locking projection 52 and is formed by connecting the vertex A with a pair of base end points B at the rear edge of the front portion 37*a* of the outer wall 37 and an outward projecting end point C substantially at the middle of the rear end 52*c* of the locking projection 52. The outer surfaces of the locking projection 52 project more outward than any side of the imaginary triangular pyramid X (i. e. straight lines connecting the vertex A and the base end points B, straight line connecting the vertex A and the projecting end point C, and straight lines connecting the base end points B and the projecting end point C). Thus, the inner volume of the locking projection 52 is larger than that of the imaginary triangular pyramid X. Accordingly, the locking projection 52 has a shape with three or more surfaces that increase in cross-section towards the back end, as seen in the inserting direction of the terminal fitting 30 into the cavity 11, and the cross-section is larger than the cross section of the imaginary triangular pyramid X.

A fittable groove 53 opens forward at a corner between the front portion 37*a* of the outer wall 37 and the right side wall 35 of FIG. 4. Thus, the fittable groove 53 is at a corner opposite from the ceiling wall 33 and the resilient contact piece 38 with respect to a height direction and at a side opposite from the front-portion holding piece 50 with respect to a widthwise direction. The supporting projection 26 at the front end of the cavity 11 is engageable with the fittable groove 53 as the female terminal fitting 30 is inserted into the cavity 11. Thus, the female terminal fitting 30 is supported and will not move loosely along vertical directions intersecting the inserting and withdrawing directions IWD of the female terminal fitting 30 or deforming direction DD of the lock 13).

The connector is assembled by first crimping the barrel 32 of the female terminal fitting 30 into connection with the wire W, and then insering the female terminal fitting 30 into the cavity 11 from behind, as shown in FIGS. 8 to 11. The female terminal fitting 30 could be upside down during an insertion attempt. However, the stabilizer 47 will contact the restricting portion 22 at the rear end of the cavity 11 to prevent an upside-down insertion of the female terminal fitting 30.

Figure 12:
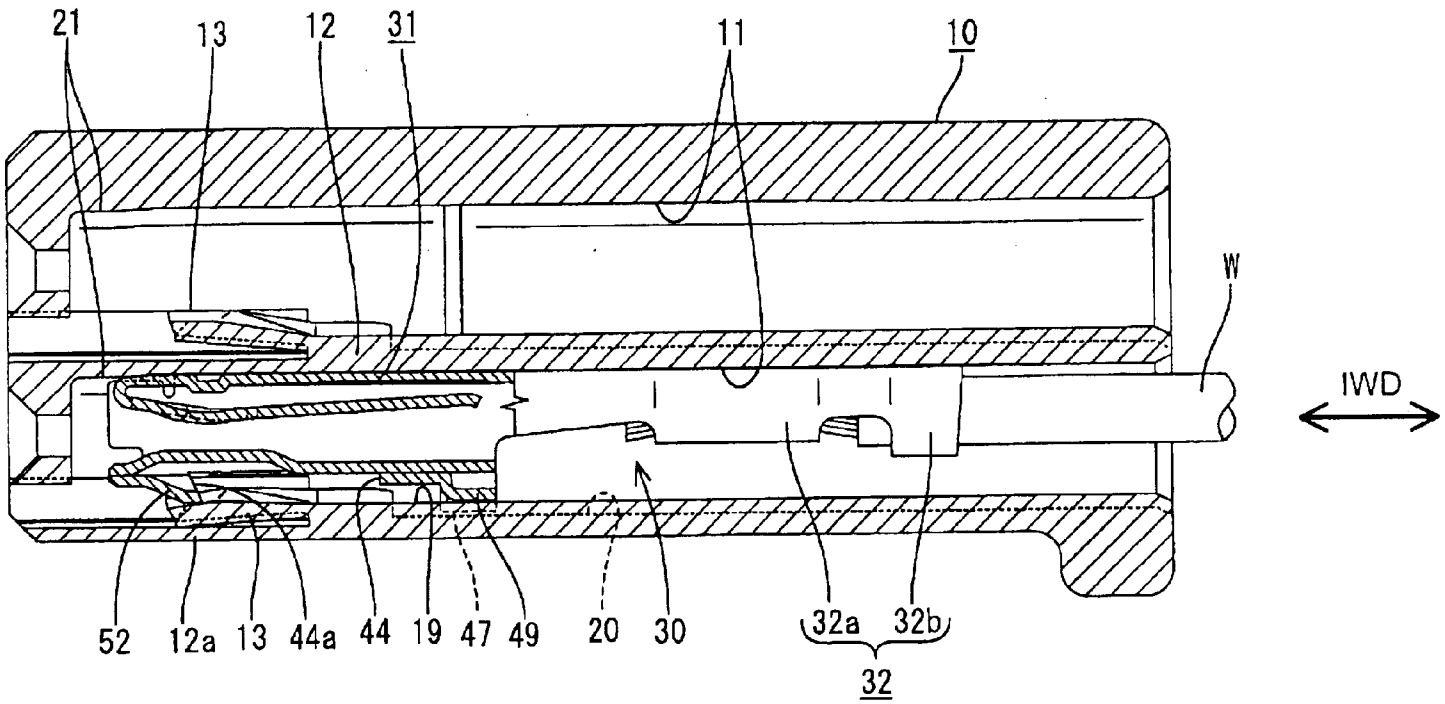
FIG. 12 is a side view in section similar to FIG. 8, but showing an intermediate stage of insertion of the female terminal fitting into the female housing.
Figure 13:
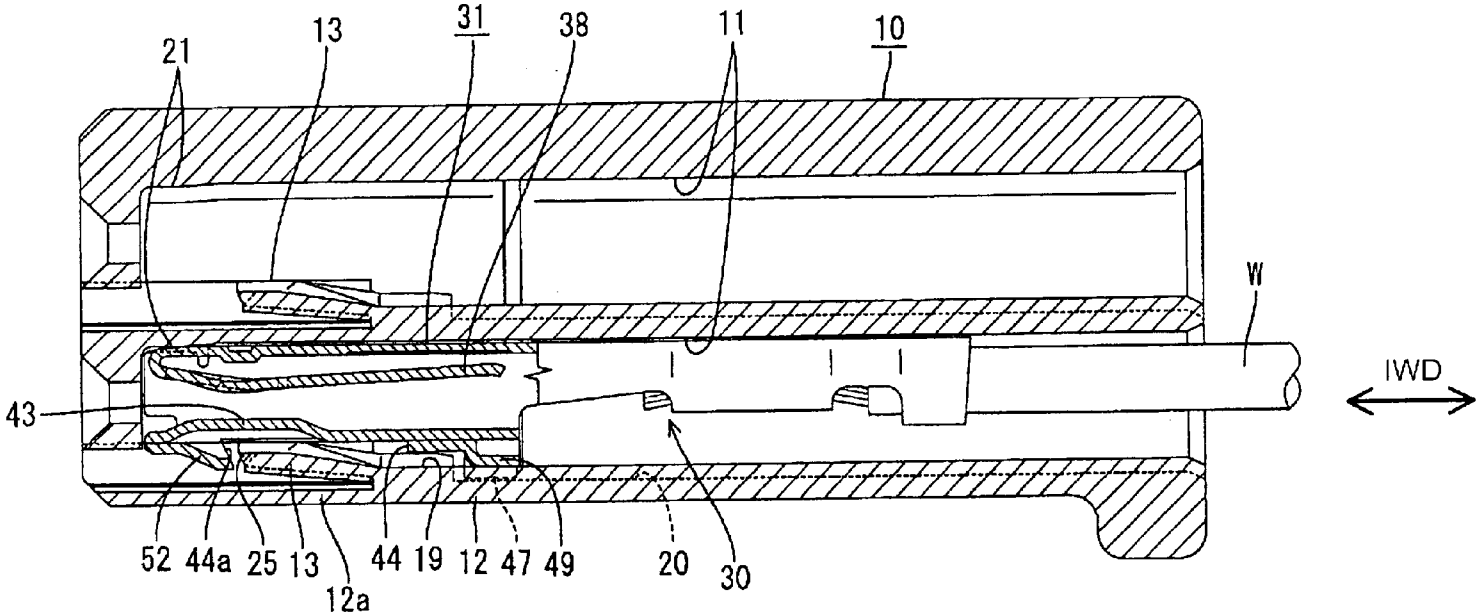
FIG. 13 is a side view in section similar to FIG. 8, but showing a state where the female terminal fitting is inserted in the female housing.
Figure 14:
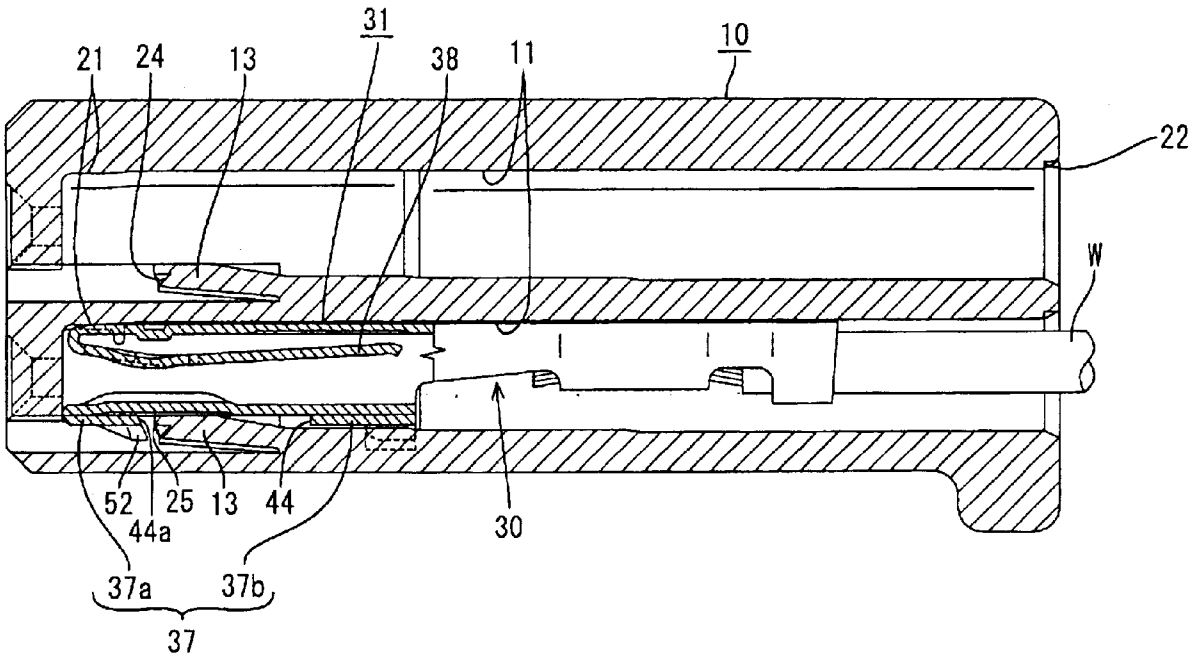
FIG. 14 is a side view in section similar to FIG. 9, but showing the state where the female terminal fitting is inserted in the female housing.

The properly oriented female terminal fitting 30 is inserted into the cavity 11 so that the locking projection 52 enters the projection-inserting groove 19. The projection 49 and the stabilizer 47 then enter the projection-inserting groove 19 and the stabilizer-inserting groove 20, respectively, so that the female terminal fitting 30 is inserted smoothly and is prevented from shaking along vertical and/or transverse directions. The locking projection 52 presses the lock 13 down, as shown in FIG. 12, when the female terminal fitting 30 is inserted to a specified depth. Maximum deformation of the lock 13 in the deformation direction DD occurs when the locking projection 52 presses the front part 13*a* of the lock 13. During this process, the locking projection 52 is inserted smoothly along the projection-inserting groove 19 and the substantially pyramidal shape with the vertex at the front end smoothly presses the lock 13.

Figure 15:
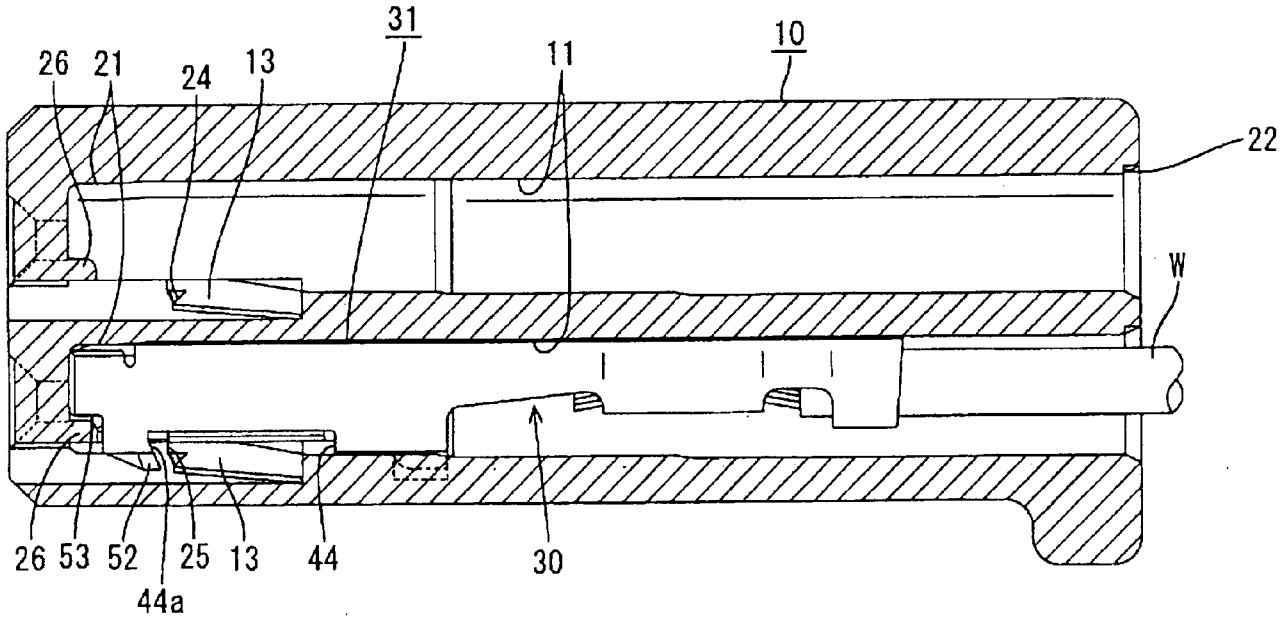
FIG. 15 is a side view in section similar to FIG. 10, but showing the state where the female terminal fitting is inserted in the female housing.
Figure 16:
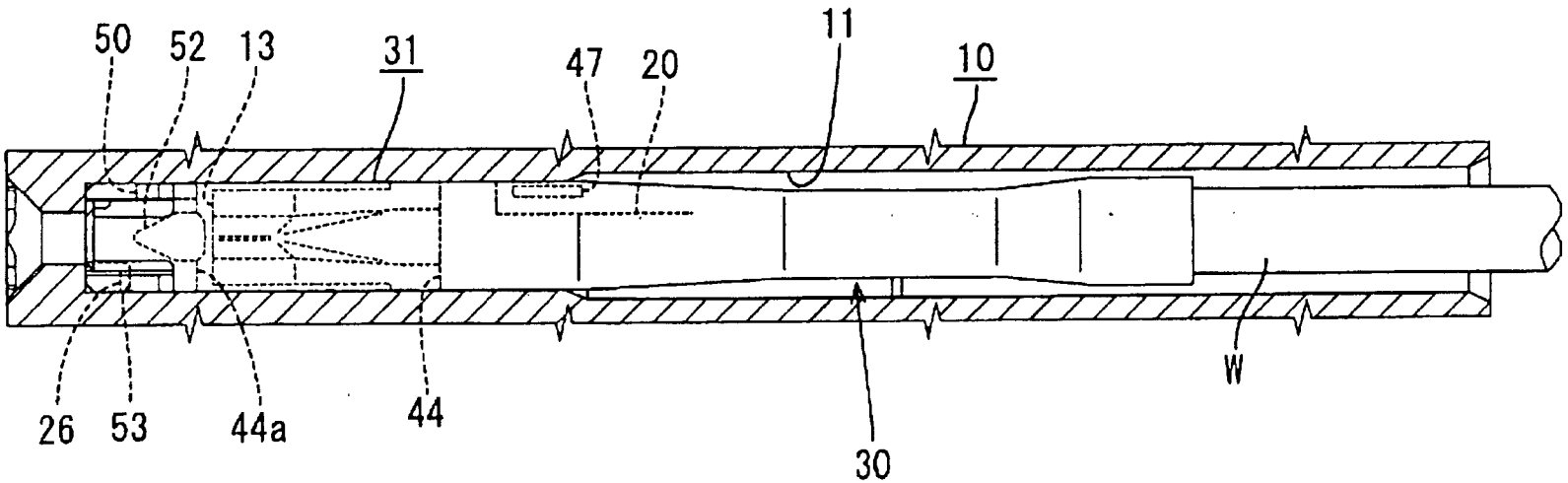
FIG. 16 is a side view in section similar to FIG. 11, but showing the state where the female terminal fitting is inserted in the female housing.
Figure 17:
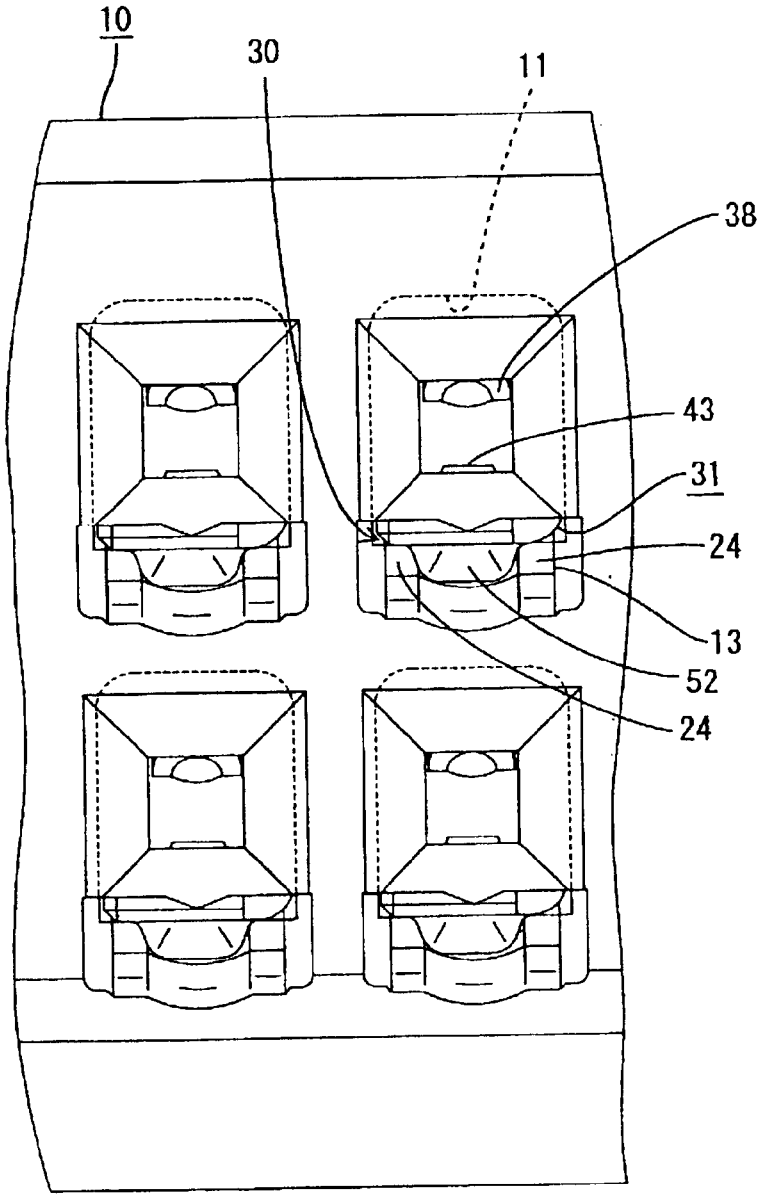
FIG. 17 is a front view showing a state where the female terminal fittings are inserted in the female housing.

The locking projection 52 moves beyond the lock 13 when the female terminal fitting 30 reaches a proper depth in the cavity 11. Thus, the lock 13 is restored resiliently and enters the cut-away portion 44 to lock the female terminal fitting 30, as shown in FIGS. 13 to 16. At this time, the projection 25 of the lock 13 projects along the inclination of the cut end surface 44*a* and enters the inside of the locking projection 52. The front end of the main body 31 is pushed down by the jutting portion 21 on the ceiling surface of the cavity 11 and is displaced toward the lock 13 in this process. Thus, the depth of engagement of the lock 13 with the female terminal fitting 30 is increased. Further, the vertical inclination of the female terminal fitting 30 is prevented by the engagement of the supporting projection 26 with the fittable groove 53, as shown in FIG. 15. The locking projection 52 is displaced from both maneuverable recesses 24 of the lock along widthwise direction and is exposed to outside together with the maneuverable recesses 24, as shown in FIG. 17.

The front cut end surface 44*a* of the cut-away portion 44, which is the locking surface engageable with the lock 13, reaches the front portion 37*a* of the outer wall 37 including the locking projection 52 and the front-portion holding piece 50. Thus, the front cut end surface 44*a* is formed over the substantially entire width of the female terminal fitting 30, as shown in FIGS. 13 to 16. As a result, the female terminal fitting 30 is held with a strong locking force and will not come out of the cavity 11. Further, the front cut end surface 44*a* of the cut-away portion 44 is inclined in and up to the back, and the locking force is even stronger.

A force may act on the locked female terminal fitting 30 via the wire W to pull the female terminal fitting 30 back. Thus, there is a possibility that the locking projection 52 of the female terminal fitting 30 will bite into the lock 13. If this occurs, part of the lock 13 will be scraped off and enter the inner space of the locking projection 52. However, the volume of the inner space of the locking projection 52 is larger than the inner volume of the imaginary triangular pyramid X shown in FIG. 7. Therefore, a larger amount of the material of the lock 13 can enter the inside of the locking projection 52, and a force necessary to pull the female terminal fitting 30 back while causing the lock 13 to bite in the locking projection 52 is increased. Hence, the female terminal fitting 30 can be held strongly.

The rear end portion 52*c* of the locking projection 52 is formed into a substantially trapezoidal or rectangular shape with an outward-projecting end that is substantially flat along the widthwise direction. Thus, an area engaged with the lock 13 is larger as compared to a locking projection where the outward-projecting end of the rear end portion is pointed. Thus, the locking force can be made larger.

The rear edge of the locking projection 52 is inclined in and up to the back and the rear edge of the front portion 37*a* of the outer wall 37 is inclined in and up to the back continuously with the rear edge of the locking projection 52. Additionally, the lock 13 is engageable with the rear edge of the locking projection 52 and the rear edge of the front portion 37*a* of the outer wall 37. Thus, the lock 13 is engaged while overhanging the rear edge of the locking projection 52 and the rear edge of the front portion 37*a* of the outer wall 37. Therefore, the locking force can be made yet even larger.

The invention is not limited to the above described and illustrated embodiment. For example, the following embodiments also are embraced by the invention as defined by the claims. Beside the following embodiments, various changes can be made without departing from the scope and spirit of the invention as defined by the claims.

The outer surfaces of the locking projection are more outward than any of the sides of the imaginary triangular pyramid in the foregoing embodiment. However, they need not be more outward than all sides of the imaginary triangular pyramid. Locking projections shaped such that the outer surfaces thereof are located more outward than at least one side of the imaginary triangular pyramid are embraced by the invention.

The locking projection has a substantially pyramidal shape in the foregoing embodiment. However, locking projections with a substantially conical or troncoconical shape or a composite or combination of a pyramid and a cone or other shapes having an increasing cross section towards the back side also are embraced by the invention. Further, although the front and rear parts of the locking projection are formed by three surfaces in the foregoing embodiment, locking projections having each of the front and rear parts formed by three or more surfaces are also embraced by the invention.

The female terminal fitting and the female connector are shown in the foregoing embodiment. However, the invention is also applicable to male terminal fittings having tabs connectable with female terminal fittings and male connectors provided with male terminal fittings.

The lock is integral or unitary with the female housing in the foregoing embodiment. However, female connectors with a separate retainer to hold female terminal fittings also are embraced by the present invention. Further, connectors using locks supported at both ends instead of cantilevered locks also are embraced by the invention.

What is claimed is:

1. A terminal fitting (30) insertable into a connector housing (10), comprising a locking projection (52) formed into an enlarging shape having a vertex (A) at a front end by forming a rear end of an outer wall (37) extending along widthwise direction to project out, and engageable with a fastener (13) in the connector housing (10) when the terminal fitting (30) is inserted into the connector housing (10), wherein the locking projection (52) is formed to be located more outward than an imaginary triangular pyramid (X) formed by connecting the vertex (A) at the front end, a pair of base end points (B) at the rear end, and an outward-projecting end point (C).

2. The terminal fitting of claim 1, wherein the locking projection (52) comprises a substantially pyramidal portion (52*a*).

3. The terminal fitting of claim 1, wherein the locking projection (52) has an outward projecting rear end which is substantially flat along a widthwise direction.

4. The terminal fitting of claim 1, wherein a rear portion (52*b*) of the locking projection (52) is formed into a substantially rectangular tubular shape (52*b*).

5. The terminal fitting of claim 4, wherein a rear end (52*c*) of the locking projection (52) is inclined out and to the back, the rear end (44*a*) of the outer wall (37) is inclined out and to the back continuously with the rear end (52*c*) of the locking projection (52).

6. The terminal fitting of claim 5, wherein the fastener (13) is engageable with the rear end (52*c*) of the locking projection (52) and the rear end (44*a*) of the outer wall (37).

7. The terminal fitting of claim 1, wherein the vertex (A) of the locking projection (52) is rounded.

8. The terminal fitting of claim 1, wherein the outer wall (37) comprises a cut-away portion (44) extending over substantially the entire width of the outer wall (37), wherein a front cut end surface (44*a*) of the cut-away portion (44) is engageable with the fastener (13).

9. A connector, comprising a connector housing (10) and at least one terminal fitting according to claim 1 inserted into at least one cavity (11) of the connector housing (10) from behind.

10. The connector of claim 9, wherein the cavity (11) has a projection inserting groove (19) for receiving the locking projection (52).

* * * * *